US011794496B2

(12) United States Patent
Yato et al.

(10) Patent No.: US 11,794,496 B2
(45) Date of Patent: Oct. 24, 2023

(54) RECORDING DEVICE AND CONTROL METHOD FOR RECORDING DEVICE

(71) Applicant: Seiko Epson Corporation, Tokyo (JP)

(72) Inventors: Keiichi Yato, Matsumoto (JP); Atsuhiko Takeuchi, Matsumoto (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,769

(22) Filed: Jan. 24, 2022

(65) Prior Publication Data

US 2022/0234371 A1 Jul. 28, 2022

(30) Foreign Application Priority Data

Jan. 26, 2021 (JP) ..... 2021-010086

(51) Int. Cl.
*B41J 11/70* (2006.01)
*B41J 11/66* (2006.01)

(52) U.S. Cl.
CPC ..... *B41J 11/663* (2013.01); *B41J 11/70* (2013.01)

(58) Field of Classification Search
CPC ... B41J 15/18; B41J 15/22; B41J 11/66; B41J 11/663; B41J 11/70; B41J 11/706
See application file for complete search history.

(56) References Cited

U.S. PATENT DOCUMENTS 5,838,354 A * 11/1998 Yamada ..... B41J 11/0085 242/530.4

FOREIGN PATENT DOCUMENTS

JP 2015-168051 9/2015
JP 2017-196680 11/2017

* cited by examiner

*Primary Examiner* — Scott A Richmond
(74) *Attorney, Agent, or Firm* — WORKMAN NYDEGGER

(57) ABSTRACT

A printer includes a transport unit, a recording unit, a cutter unit, and a control unit. The transport unit is capable of transporting two pieces of roll paper in parallel. The cutter unit is movable in a width direction intersecting a transport direction, and is capable of cutting the two pieces of roll paper. The cutter unit is capable of cutting roll paper PR in both a forward path and a return path of the movement in a width direction. The control unit is capable of setting a standby position of the cutter unit to a position between the two pieces of roll paper.

8 Claims, 10 Drawing Sheets

RECORDING DEVICE AND CONTROL METHOD FOR RECORDING DEVICE

The present application is based on, and claims priority from JP Application Serial Number 2021-010086, filed Jan. 26, 2021, the disclosure of which is hereby incorporated by reference herein in its entirety.

BACKGROUND

1. Technical Field

The present disclosure relates to a recording device and a control method for a recording device.

2. Related Art

In a sheet cutting apparatus described in JP 2015-168051 A, a cutter housing is rotationally moved that includes a cutter that cuts a sheet when heading toward one side in a sheet width direction, and a cutter that cuts the sheet when heading toward another side in the sheet width direction. Thus, cutting the sheet in a forward path and cutting the sheet in a return path are performed.

In the configuration of JP 2015-168051 A, when a cutting unit is positioned at a home position being a 0-th place, in order to cut a long medium positioned on a side opposite to the home position side of two long media wound at the same time, the long medium on the home position side that obstructs movement needs to be cut, and there is a possibility that cutting at any timing cannot be performed.

SUMMARY

In order to solve the above-described problems, a recording device according to the present disclosure includes a transport unit capable of transporting two long media in parallel, a recording unit capable of recording on the two long media transported in parallel, a cutting unit disposed downstream the recording unit in a transport direction of the long medium, movable in a width direction intersecting the transport direction, and capable of cutting the two long media, and a control unit configured to control the transport unit, the recording unit, and the cutting unit, wherein the cutting unit is capable of cutting the long medium in both a forward path and a return path of the movement in the width direction, and the control unit is capable of setting a standby position of the cutting unit to a position between the two long media.

In order to solve the above-described problems, a control method for a recording device according to the present disclosure is a control method for a recording device including a transport unit capable of transporting two long media in parallel, a recording unit capable of recording on the two long media transported in parallel, and a cutting unit disposed downstream the recording unit in a transport direction of the long medium, movable in a width direction intersecting the transport direction, and capable of cutting the two long media, the cutting unit capable of cutting the long medium in both a forward path and a return path of the movement in the width direction, the control method including setting a standby position of the cutting unit to a position between the two long media, and causing the cutting unit to cut the two long media on which recording was performed.

DESCRIPTION OF EXEMPLARY EMBODIMENTS

Figure 1:
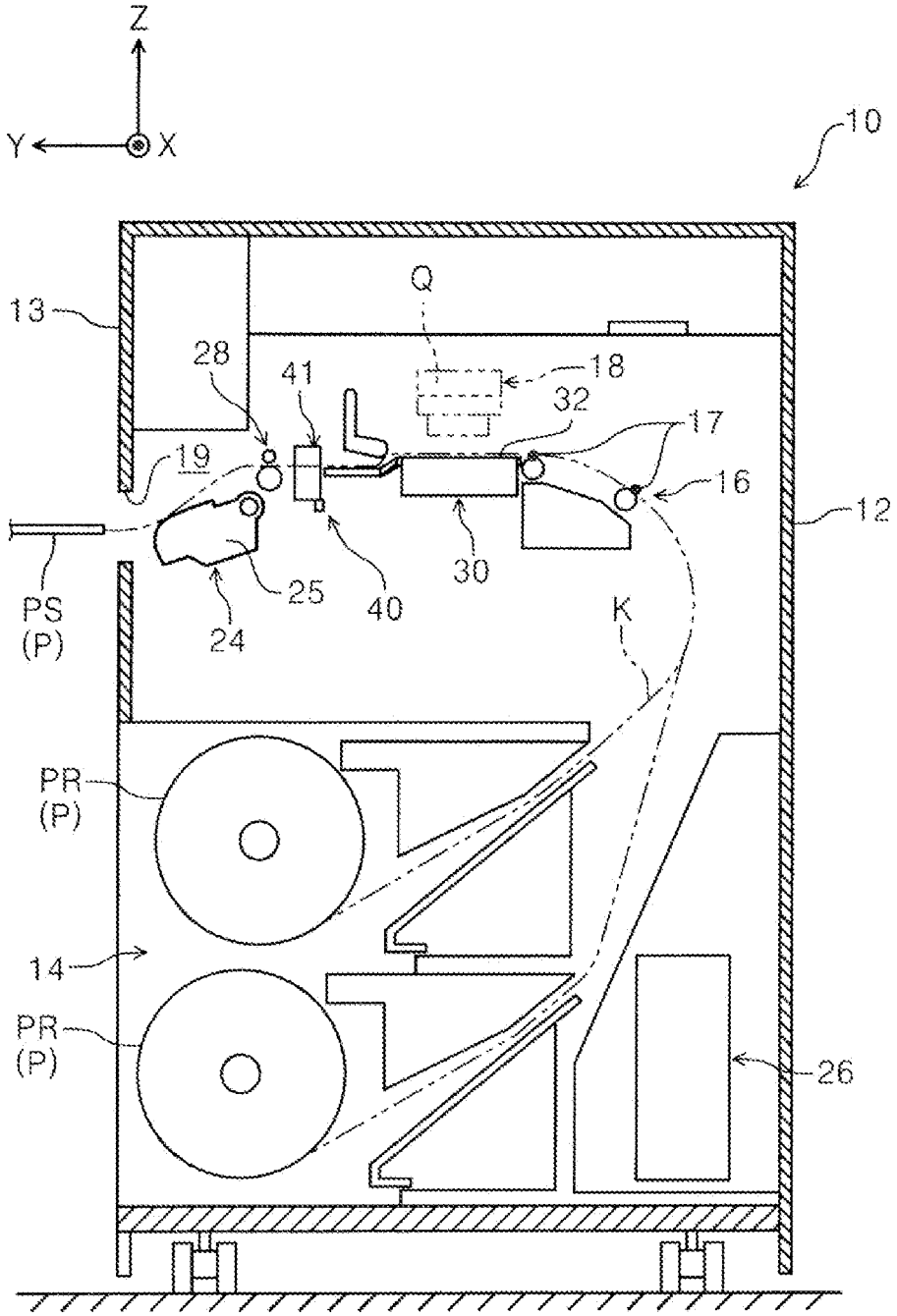
FIG. 1 is an overall configuration view of a printer according to Exemplary Embodiment 1.

The following is a schematic description of a first aspect to an eighth aspect of the present disclosure.

In order to solve the above-described problems, a recording device according to a first aspect of the present disclosure includes a transport unit capable of transporting two long media in parallel, a recording unit capable of recording on the two long media transported in parallel, a cutting unit disposed downstream the recording unit in a transport direction of the long medium, movable in a width direction intersecting the transport direction, and capable of cutting the two long media, and a control unit configured to control the transport unit, the recording unit, and the cutting unit, wherein the cutting unit is capable of cutting the long medium in both a forward path and a return path of the movement in the width direction, and the control unit is capable of setting a standby position of the cutting unit to a position between the two long media.

According to the present aspect, the two long media after recording by the recording unit is cut by the cutting unit moving in the width direction to form media that are each a single sheet.

Here, when respective recording lengths in the transport direction of the two long media are different, the standby position of the cutting unit is set to a position between the two long media, and thus the two long media can be cut at any timing regardless of which of the two long media is cut earlier.

A recording device according to a second aspect is the recording device according to the first aspect, wherein the control unit is capable of setting a standby position in the width direction of the cutting unit to a first position on an outside in the width direction with respect to the long medium, and to a second position between the two long media.

According to the present aspect, when one number of the long medium, which is wide, is cut, a standby position in the width direction of the cutting unit is set to a position, which is the first position, on an outside of any of the long media in the width direction. Further, when the two long media are cut, a standby position in the width direction of the cutting unit is set to a position, which is the second position, between the two long media. In this way, regardless of whether the number of the long media is one or two, interference of the cutting unit with a transport path of the long medium can be suppressed.

A recording device according to a third aspect is the recording device according to the second aspect, wherein the control unit is capable of changing the second position in the width direction, in accordance with a size in the width direction of the long medium being transported.

According to the present aspect, when the two long media are cut, a standby position of the cutting unit can be changed in accordance with the size in the width direction of the long medium. In this way, for example, when the size in the width direction of the long medium is small, setting the second position closer to the long medium prevents a distance between the cutting unit and the long medium from being excessively large, thus, a delay in start timing of cutting when the cutting unit cuts the long medium can be suppressed. Furthermore, the long media with a variety of widths can be supported. For example, even in a combination of the long medium less than half a transport path width and the long medium greater than half that, recording and cutting are possible.

A recording device according to a fourth aspect is the recording device according to any one of the first to third aspects, wherein the control unit returns the cutting unit to a position between the two long media after the cutting unit cuts any one of the two long media.

According to the present aspect, when the two long media are cut, the cutting unit returns to a standby position between the two long media after cutting the long medium, thus, regardless of which of the two long media is cut earlier, the two long media can be cut at any timing, and it is possible to prevent start timing of cutting the long medium from being delayed.

A recording device according to a fifth aspect is the recording device according to any one of the first to third aspects, wherein the control unit does not return the cutting unit to a position between the two long media when, after one of the two long media is cut, and subsequently the one of the long media is cut.

According to the present aspect, the cutting unit is capable of cutting the long medium in both the forward path and the return path. Here, when one of the long media is continuously cut, the cutting unit is not returned to a position between the two long media even when the cutting unit is positioned on an outside in the width direction with respect to the long medium. This makes it possible to prevent a time required for cutting the long medium from extending, because the need for waiting time to return the position of the cutting unit is eliminated.

A recording device according to a sixth aspect is the recording device according to any one of the first to fifth aspects, wherein the cutting unit includes a main body portion provided so as to be movable in the width direction, a first cutting blade provided on one side with respect to a center in the width direction of the main body portion and configured to cut the long medium in the width direction, a second cutting blade provided on another side with respect to the center in the width direction of the main body portion and configured to cut the long medium in the width direction, and a guide unit provided between the first cutting blade and the second cutting blade in the main body portion, and configured to guide the long medium cut by one of the first cutting blade and the second cutting blade in a direction away from another of the first cutting blade and the second cutting blade.

According to the present aspect, the long medium cut by the one of the first cutting blade and the second cutting blade is guided by the guide unit to move in the direction away from the other of the first cutting blade and the second cutting blade. Thus, the long medium cut by the one of the first cutting blade and the second cutting blade can be prevented from being cut for the second time by the other of the first cutting blade and the second cutting blade.

A recording device according to a seventh aspect is the recording device according to any one of the first to sixth aspects that includes a transmission unit configured to transmit position information in the width direction of the cutting unit to the control unit, wherein the control unit, based on the position information, when at least a part of the cutting unit is positioned inside a transport region of the long medium, stops transport of the long medium in the transport unit.

According to the present aspect, it is possible to prevent interference between the long medium transported by the transport unit and the cutting unit.

A control method for a recording device according to an eighth aspect is a control method for a recording device including a transport unit capable of transporting two long media in parallel, a recording unit capable of recording on the two long media transported in parallel, and a cutting unit disposed downstream the recording unit in a transport direction of the long medium, movable in a width direction intersecting the transport direction, and capable of cutting the two long media, the cutting unit capable of cutting the long medium in both a forward path and a return path of the movement in the width direction, the control method including setting a standby position of the cutting unit to a position between the two long media, and causing the cutting unit to cut the two long media on which recording was performed.

According to the present aspect, an action effect similar to that in the recording device according to the first aspect can be obtained.

An example of the recording device and the control method for the recording device according to the present disclosure will be described below in detail. In each of the drawings, an X direction along an X-axis is an example of a width direction of a printer 10, which will be described later, and a width direction of a long medium. A −X direction is a left direction as viewed from a user when a device front face faces the user, and an +X direction is a right direction.

A Y direction along a Y-axis is an example of a device depth direction of the printer 10. A +Y direction is a direction heading from a device rear face toward the front face, and is an example of a transport direction on a platen 30 of a sheet P, which will be described later. A −Y direction is a direction heading from the device front face toward the rear face. The X and Y directions are horizontal directions.

A Z direction along a Z-axis is a device height direction of the printer 10 and a vertical direction, a +Z direction is vertically upward, and a −Z direction is vertically downward. The X direction, the Y direction, and the Z direction are mutually orthogonal. The sheet P is an example of the long medium. In the following description, the sheet P in a roll shape is referred to as roll paper PR, and is distinguished from the sheet P in a sheet shape that is referred to as cut paper PS.

Exemplary Embodiment 1

In FIG. 1, the printer 10 is illustrated as an example of a recording device according to Exemplary Embodiment 1. In the +Y direction for the printer 10, a loading device (not illustrated) is provided on which the cut paper PS is to be loaded. The printer 10 includes a cuboid-shaped housing 12. In the printer 10, recording on plain paper and photographic paper is also possible.

Specifically, the printer 10 includes a storage unit 14, a transport unit 16, a recording unit 18, a discharge unit 24, a control unit 26, the platen 30, and a cutting system 40 including a cutter unit 41, in an inside of the housing 12.

The housing 12 includes a side wall 13 that constitutes a wall portion in the +Y direction of the housing 12. A discharge port 19 that penetrates in the Y direction is formed in the side wall 13.

As an example, the storage unit 14 stores a total of four pieces of the roll paper PR each rotated around a center axis along the X direction, the four pieces including two pieces with an interval in the X direction for each of upper and lower two stages.

The transport unit 16 includes a plurality of transport roller pairs 17. Furthermore, the transport unit 16 transports the roll paper PR, drawn from the storage unit 14, downstream along a transport path K indicated by long dashed double-short dashed line. Furthermore, the transport unit 16 is capable of transporting only one number of the roll paper PR, or two number of the roll paper PR in parallel in the X direction.

The recording unit 18 is capable of recording on a piece of the roll paper PR, or on two pieces of the roll paper PR that are transported in parallel in the X direction, while being moved in the X direction. Specifically, the recording unit 18 records on the roll paper PR transported in the +Y direction by the transport unit 16, by discharging ink Q as an example of droplets while being reciprocally moved in the X direction. Note that, the roll paper PR is transported in the +Y direction, in a region facing the recording unit 18. Additionally, the recording unit 18 is positioned in the +Z direction with respect to the roll paper PR. In other words, recording is performed on an upper surface in the +Z direction of the roll paper PR. Furthermore, the recording unit 18 is capable of recording on the roll paper PR having a plurality of sizes with different widths in the X direction.

The discharge unit 24 includes a support 25 disposed downstream the cutter unit 41 described below, and a discharge roller pair 28. The support 25 supports and guides the cut paper PS cut by the cutter unit 41 to the discharge port 19. The discharge roller pair 28 transports the cut paper PS cut toward the support 25. The cut paper PS discharged from the discharge port 19 is transported to the loading device (not illustrated).

The platen 30 is disposed facing the recording unit 18, and extends in the X direction. The platen 30 supports the roll paper PR. In addition, the platen 30 is formed in a hollow, rectangular cylindrical shape, and is exhausted by an exhaust unit (not illustrated), thereby making an inside thereof is a negative pressure chamber. Thus, the roll paper PR being transported is attracted to the platen 30.

Figure 2:
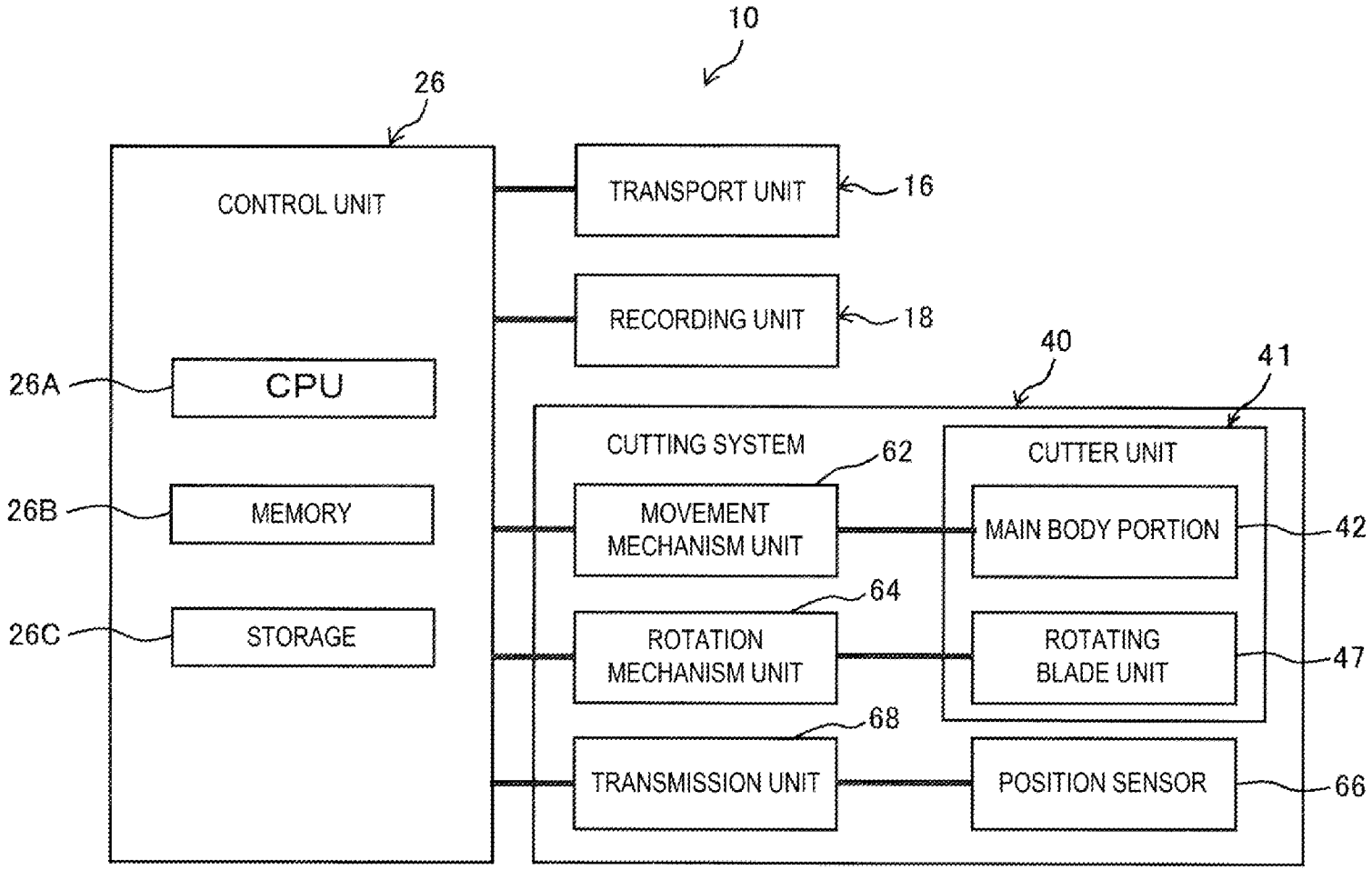
FIG. 2 is a block diagram of the printer according to Exemplary Embodiment 1.

As illustrated in FIG. 2, the control unit 26 controls operation of the transport unit 16, the recording unit 18, and the cutter unit 41, which is described below. Specifically, the control unit 26 is configured as a computer including a Central Processing Unit (CPU) 26A, a memory 26B, and a storage 26C. Note that, control of the operation of the cutter unit 41 by the control unit 26 will be described later.

The cutting system 40 includes, as an example, the cutter unit 41, a movement mechanism unit 62, a rotation mechanism unit 64, a position sensor 66, and a transmission unit 68.

The cutter unit 41 includes a main body portion 42, and a rotating blade unit 47. Note that, details of the cutter unit 41 will be described later.

The movement mechanism unit 62 moves the main body portion 42 in the X direction. The rotation mechanism unit 64 rotates the rotating blade unit 47 described later. In the present exemplary embodiment, as an example, the movement mechanism unit 62 and the rotation mechanism unit 64 are assembled as one mechanism unit.

As an example, the movement mechanism unit 62 and the rotation mechanism unit 64 are configured to include a slider, a motor, a timing belt, and a pulley (not illustrated), and operation thereof is controlled by the control unit 26.

The slider that allows the cutter unit 41 to move in the X direction is attached to the timing belt. The timing belt is moved in the X direction by rotation of the motor. This allows the cutter unit 41 to move in the X direction. The timing belt has a width greater than a width of a maximum size of the roll paper PR.

The rotating blade unit 47 described below is linked to a pulley. The pulley is in contact with the timing belt. Thus, as the timing belt moves, the rotating blade unit 47 is rotated. In this way, the cutting system 40 has structure in which the rotating blade unit 47 is rotated in conjunction with movement in the X direction of the cutter unit 41.

The position sensor 66 detects a position in the X direction of the main body portion 42. In the present exemplary embodiment, as an example, the position sensor 66, which is of an optical type, is used, but a magnetic position sensor or other type of position sensor may be used. Position information in the X direction of the main body portion 42 obtained in the position sensor 66 is transmitted to the control unit 26 via the transmission unit 68. Note that, the position sensor 66 and the transmission unit 68 may be integrated.

As illustrated in FIG. 1, the cutter unit 41 is disposed downstream the recording unit 18 and upstream the discharge unit 24 in the +Y direction, which is the transport direction of the roll paper PR. The cutter unit 41 is movable in the X direction intersecting the Y direction. The cutter unit 41 is capable of cutting two pieces of the roll paper PR disposed side by side in the X direction. Furthermore, the cutter unit 41 is capable of cutting the roll paper PR in both the forward path and the return path of the movement in the X direction. Note that, while both the forward path and the return path are along the X direction, orientation of the forward path and the return path varies depending on a situation in which cutting is performed.

Figure 3:
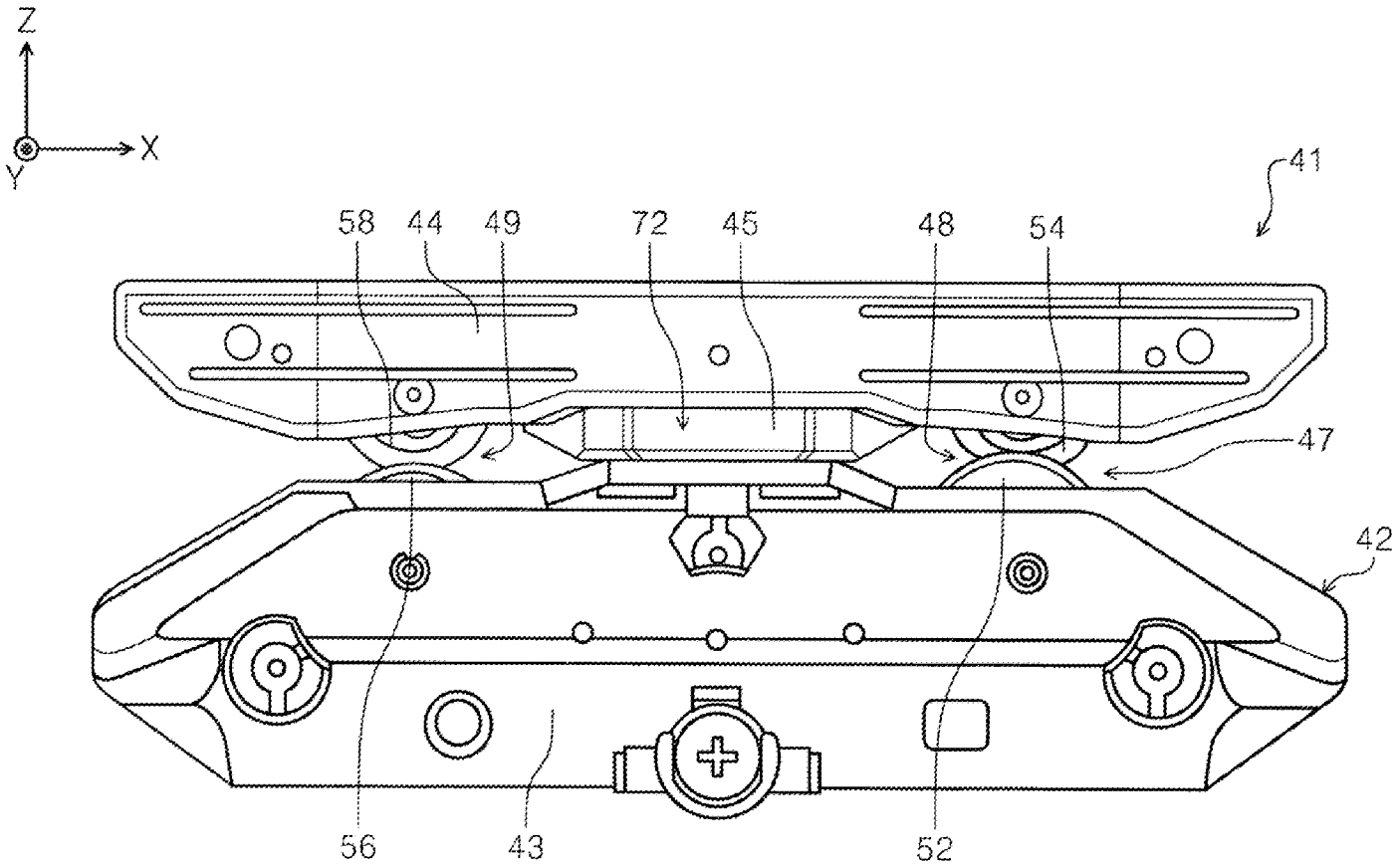
FIG. 3 is a side view of a moving unit of the printer according to Exemplary Embodiment 1.

As illustrated in FIG. 3, the cutter unit 41 is an example of the cutting unit, and includes the main body portion 42, the rotating blade unit 47 provided at the main body portion 42, and a guide unit 72 provided at the main body portion 42. Then, the cutter unit 41 cuts the roll paper PR after recording by the recording unit 18 (FIG. 1) to form the cut paper PS.

The main body portion 42 is provided so as to be movable in the X direction by the movement mechanism unit 62 (FIG. 2). Further, the main body portion 42 includes a main body lower portion 43, a main body upper portion 44, and a coupling portion 45.

The main body lower portion 43 configures a portion in the −Z direction from a center in the Z direction of the main body portion 42. The main body lower portion 43 is formed as a long member extending in the X direction.

The main body upper portion 44 configures a portion in the +Z direction from the center in the Z direction of the main body portion 42. The main body upper portion 44 is formed as a long member extending in the X direction.

The coupling portion 45 configures a central portion in the Z direction of the main body portion 42. The coupling portion 45 links, in the Z direction, a central portion in the X direction of the main body lower portion 43, and a central portion in the X direction of the main body upper portion 44. The coupling portion 45 also functions as a strut that supports the main body upper portion 44. On portions other than the coupling portion 45 in the main body portion 42, the main body lower portion 43 and the main body upper portion 44 are disposed with an interval in the Z direction. The guide unit 72, which will be described later, is provided at the coupling portion 45.

The rotating blade unit 47 is, as an example, configured with a first cutting blade 48, and a second cutting blade 49. The first cutting blade 48 is provided in the +X direction, which is one side with respect to a center in the X direction of the main body portion 42. The first cutting blade 48 cuts, in the +X direction, the roll paper PR being transported in the +Y direction. Specifically, the first cutting blade 48 is configured with a lower rotating blade 52 and an upper rotating blade 54. Then, the first cutting blade 48 cuts the roll paper PR in the +X direction, by the lower rotating blade 52 and the upper rotating blade 54 rotated in a state of sandwiching the roll paper P.

The lower rotating blade 52 is protruded in the +Z direction from the main body lower portion 43 at a part in the +X direction from a center in the X direction of the main body lower portion 43, and is provided so as to be able to rotate about an axis along the Y direction.

The upper rotating blade 54 is protruded in the −Z direction from the main body upper portion 44 at a part in the +X direction from a center in the X direction of the main body upper portion 44, and is provided so as to be able to rotate about an axis along the Y direction.

The second cutting blade 49 is provided in the −X direction, which is another side with respect to the center in the X direction of the main body portion 42. The second cutting blade 49 cuts, in the +X direction, the roll paper PR being transported in the +Y direction. Specifically, the second cutting blade 49 is configured with a lower rotating blade 56 and an upper rotating blade 58. Then, the second cutting blade 49 cuts the roll paper PR in the −X direction, by the lower rotating blade 56 and the upper rotating blade 58 rotated in a state of sandwiching the roll paper P.

The lower rotating blade 56 is protruded in the +Z direction from the main body lower portion 43 at a part in the −X direction from the center in the X direction of the main body lower portion 43, and is provided so as to be able to rotate about an axis along the Y direction.

The upper rotating blade 58 is protruded in the −Z direction from the main body upper portion 44 at a part in the −X direction from the center in the X direction of the main body upper portion 44, and is provided so as to be able to rotate about an axis along the Y direction.

Note that, as an example, the first cutting blade 48 and the second cutting blade 49 are disposed and configured to be linearly symmetrical with respect to a line (not illustrated) passing through a center in the X direction of the main body portion 42 and extending in the Z direction.

Figure 4:
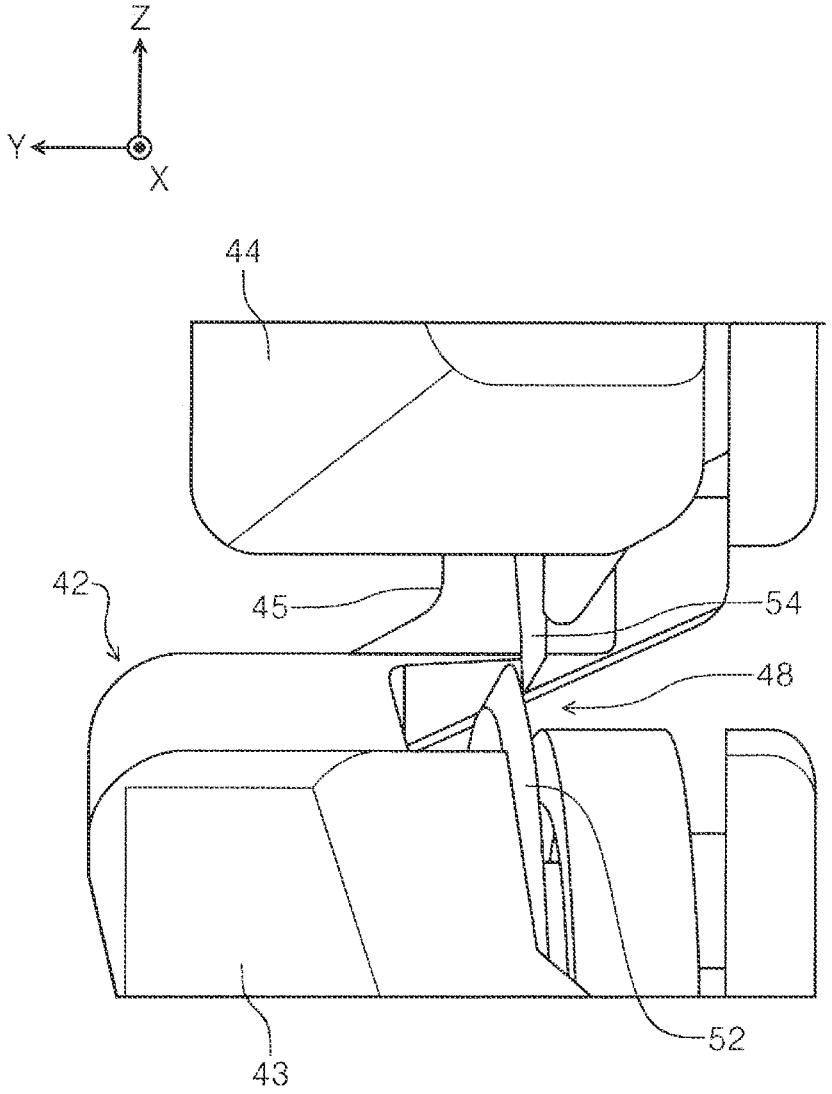
FIG. 4 is an enlarged view enlarging a part of the moving unit and a rotating blade in the printer according to Exemplary Embodiment 1.

As illustrated in FIG. 4, in the first cutting blade 48, the upper rotating blade 54 is disposed approximately along an X-Z plane, while the lower rotating blade 52 is disposed along a direction intersecting the X-Z plane. A position at which the lower rotating blade 52 and the upper rotating blade 54 contacts each other is a cutting position at which the sheet P is cut.

Note that, the second cutting blade 49 (FIG. 3) is configured to be linearly symmetrical with the first cutting blade 48 as described above, and thus descriptions thereof will be omitted.

Figure 5:
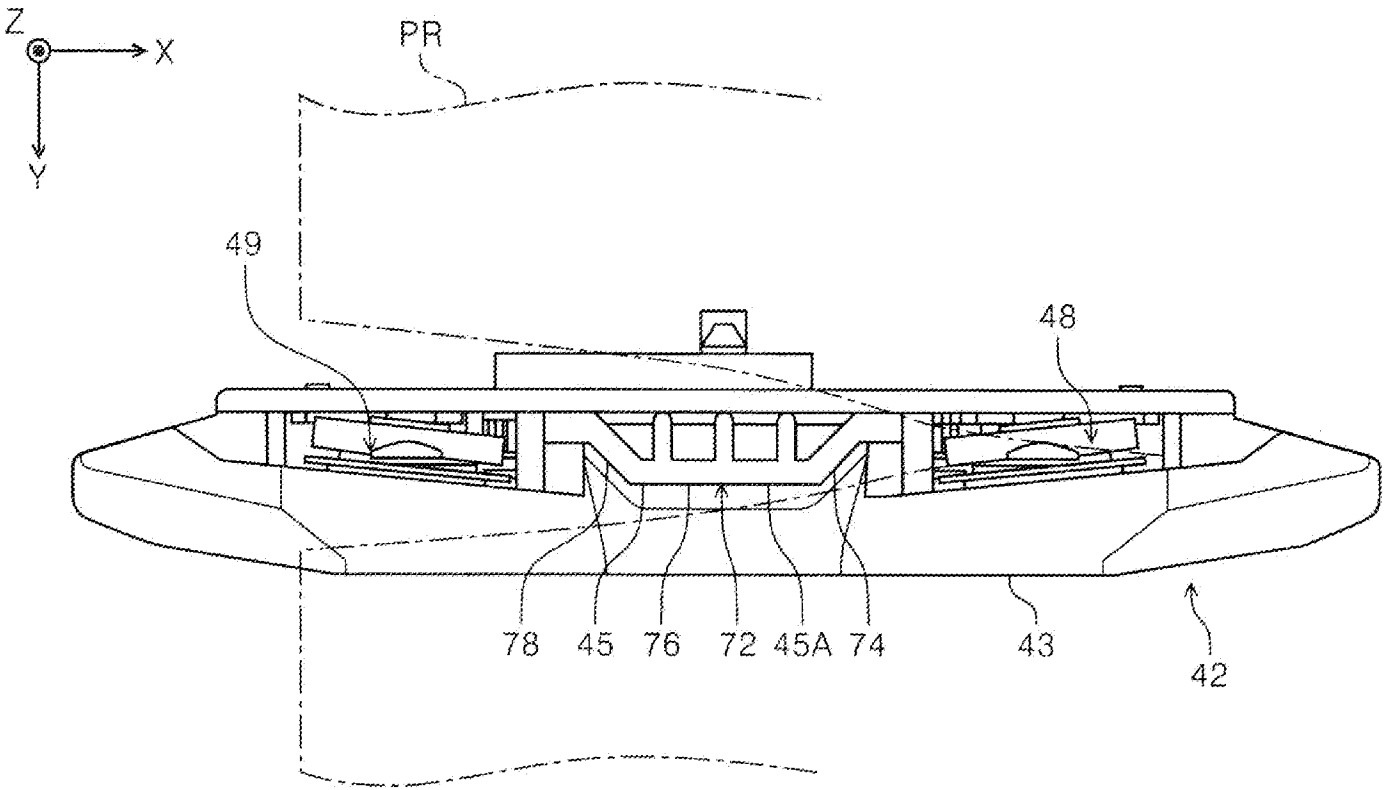
FIG. 5 is a cross-sectional view of a lower portion of the moving unit in the printer according to Exemplary Embodiment 1 as viewed from above.

As illustrated in FIG. 5, the guide unit 72 is provided between the first cutting blade 48 and the second cutting blade 49 in the main body portion 42. Further, the guide unit 72 guides the roll paper PR cut by one of the first cutting blade 48 and the second cutting blade 49, in a direction away from another of the first cutting blade 48 and the second cutting blade 49.

Specifically, as an example, the guide unit 72 is formed at a side surface 45A in the +Y direction of the coupling portion 45. Additionally, the guide unit 72 includes a first inclined surface 74, a flat surface 76, and a second inclined surface 78.

The first inclined surface 74 is a surface that is inclined in a direction intersecting the X direction as viewed in the +Z direction, and an end portion in the −X direction is positioned in the +Y direction with respect to an end portion in the +X direction. Then, the first inclined surface 74 guides, in the +Y direction, a portion separated in the +Y direction of the roll paper PR cut by the first cutting blade 48.

The flat surface 76 extends in the +X direction from the end portion in the +X direction of the first inclined surface 74. Also, the flat surface 76 is a flat surface along the X-Z plane. The flat surface 76 guides the roll paper PR in the −X direction or the +X direction.

The second inclined surface 78 is a surface that is inclined in a direction intersecting the X direction as viewed in the +Z direction, and an end portion in the +X direction is positioned in the +Y direction with respect to an end portion in the −X direction. Then, the second inclined surface 78 guides, in the +Y direction, a portion separated in the +Y direction of the roll paper PR cut by the second cutting blade 49.

Note that, as an example, the first inclined surface 74 and the second inclined surface 78 are formed symmetrically with respect to a center in the X direction of the coupling portion 45.

Control performed by the control unit 26 in the printer 10 illustrated in FIG. 2 will be described. Note that, for each unit constituting the printer 10, reference is made to FIG. 1 to FIG. 5, and descriptions of individual drawing numbers will be omitted.

The control unit 26 sets a standby position of the cutter unit 41 to a position between the two pieces of roll paper PR, in a mode in which the recording unit 18 records in parallel on the two pieces of roll paper PR aligned in the X direction.

The control unit 26 is capable of setting the standby position of the cutter unit 41 in the X direction to a first position on an outer side in the X direction with respect to the roll paper PR, and to a second position between the two pieces of roll paper PR aligned in the X direction. As an example, in a mode in which only one piece of the roll paper PR is transported in the +X direction, the first position in the +X direction with respect to the roll paper PR is set to the standby position. Furthermore, in a mode in which two pieces of the roll paper PR are transported in parallel, the second position is set to the standby position.

The control unit 26 is capable of changing the second position in the X direction, in accordance with a size in the X direction of the roll paper PR being transported. In other words, when the size in the X direction of the roll paper PR is changed from small to large, the control unit 26 shifts the second position in the −X direction so that the cutter unit 41 and the roll paper PR are not in contact.

The control unit 26, after the cutter unit 41 cuts one of the two pieces of roll paper PR, returns the cutter unit 41 to a position between the two pieces of roll paper PR.

Figure 8:
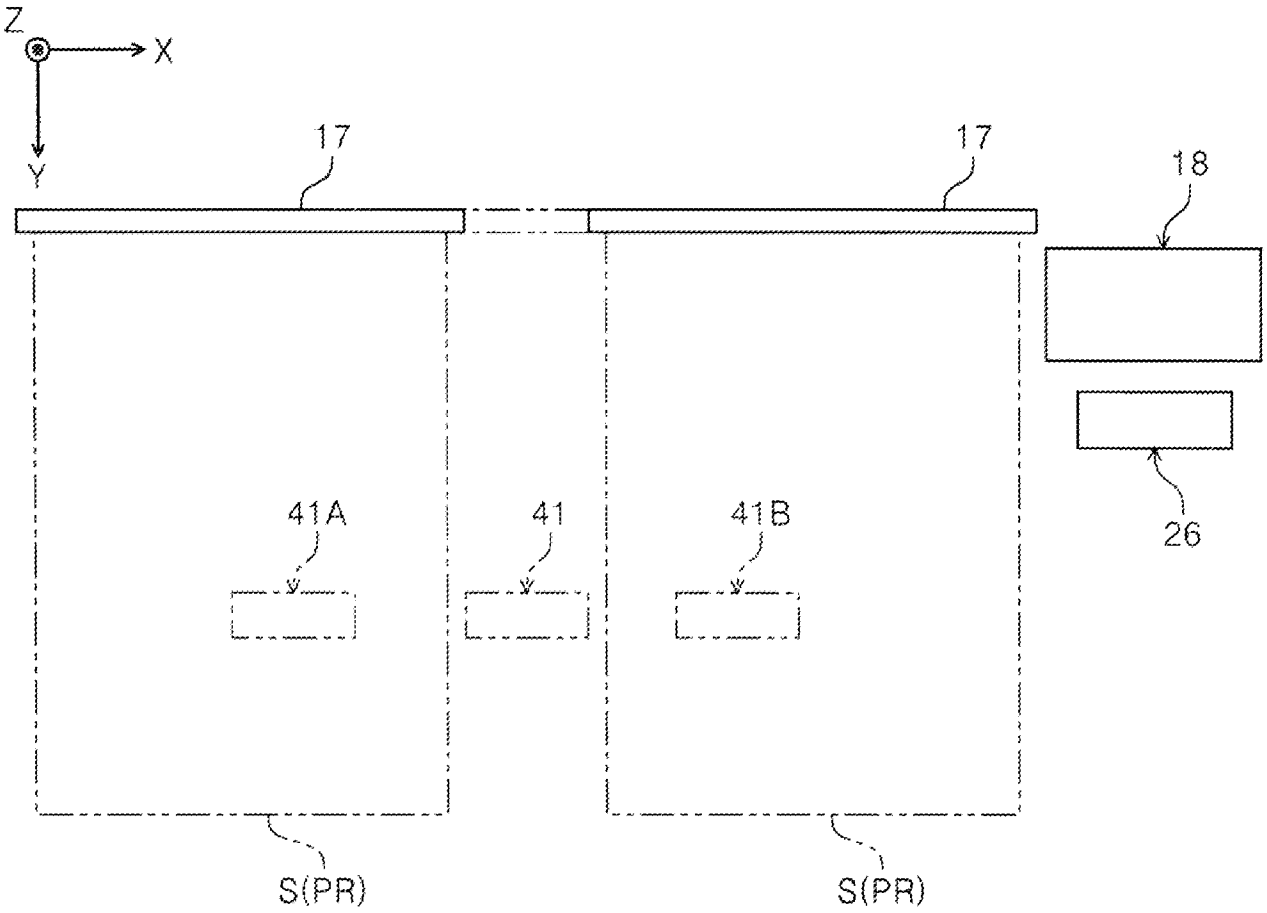
FIG. 8 is a schematic diagram illustrating a state in which a cutting unit is positioned in a transport region of the roll paper in the printer according to Exemplary Embodiment 1.

As illustrated in FIG. 8, the control unit 26, based on position information in the X direction of the cutter unit 41 obtained in the position sensor 66, stops transporting the roll paper PR in the transport unit 16, when at least a part of the cutter unit 41 is positioned inside a transport region S of the roll paper PR. For example, as in a cutter unit 41A or a cutter unit 41B indicated by an imaginary line in FIG. 8, transport of the roll paper PR is stopped when the cutter unit 41 is positioned inside the transport region S.

After setting the standby position of the cutter unit 41 to a position between the two pieces of roll paper PR, the control unit 26 controls for recording on the two pieces of roll paper PR, and for causing the cutter unit 41 to cut the two pieces of roll paper PR after recording.

Next, actions of the printer 10 according to Exemplary Embodiment 1 will be described. For each unit of the printer 10, reference is made to FIG. 1 to FIG. 5, and descriptions of individual drawing numbers will be omitted.

Figure 6A:
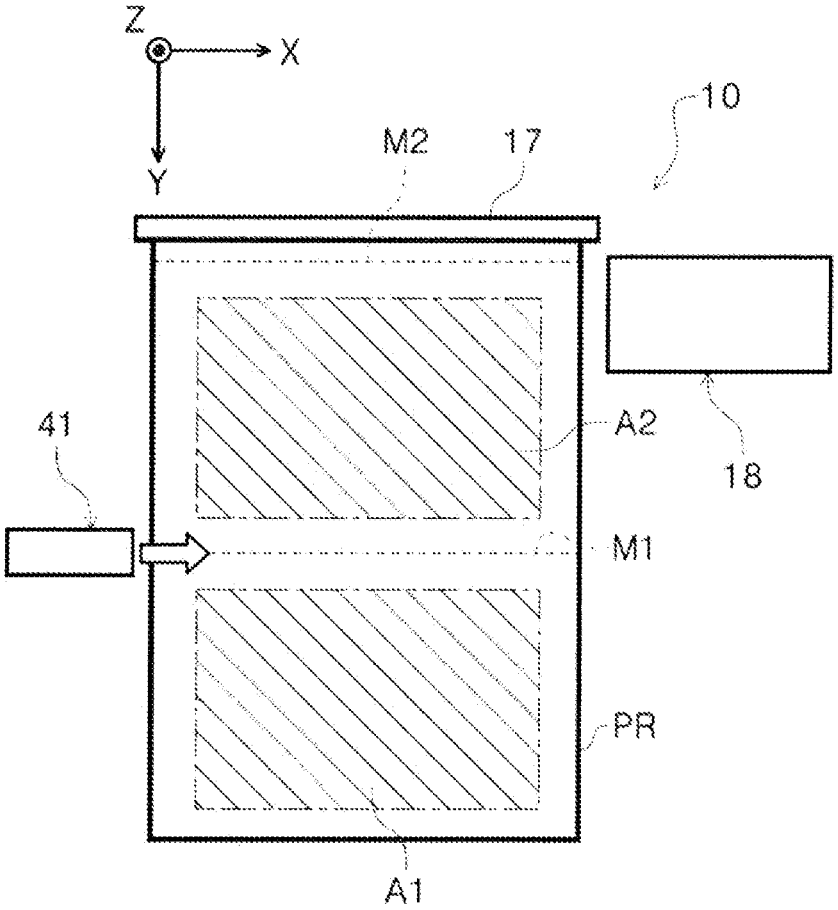
FIG. 6A is a schematic diagram illustrating a state in which roll paper is cut from one side in a width direction in the printer according to Exemplary Embodiment 1.

As illustrated in FIG. 6A, a case in which there is one piece of the roll paper PR will be described. A first image A1 and a second image A2 are formed on the roll paper PR after recording. In addition, on the roll paper PR, a planned cut position M1 is set between the image A1 and the image A2, and a planned cut position M2 is set to a position in the −Y direction with respect to the image A2. The planned cut positions M1 and M2 are indicated by imaginary lines M1 and M2, respectively, but are not actually visible.

When the planned cut position M1 reaches the +X direction with respect to the cutter unit 41 by transporting of the roll paper PR, moving of the cutter unit 41 in the +X direction is started. Then, the first cutting blade 48 (FIG. 3) cuts the roll paper PR in the +X direction.

Figure 6B:
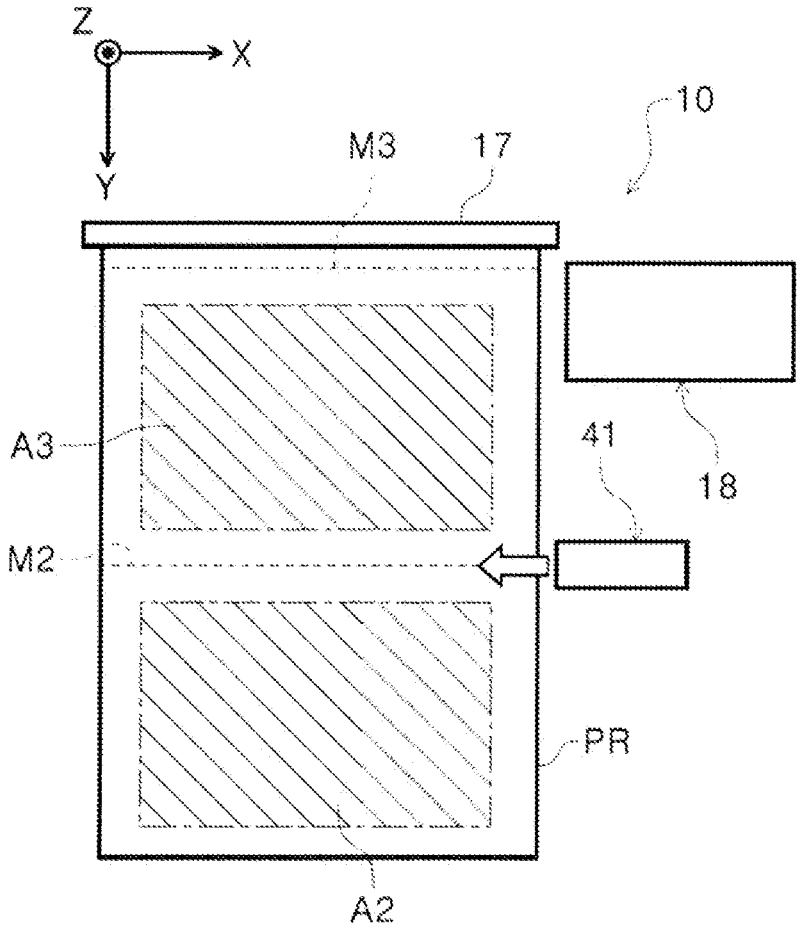
FIG. 6B is a schematic diagram illustrating a state in which roll paper is cut from another side in the width direction in the printer according to Exemplary Embodiment 1.

As illustrated in FIG. 6B, the planned cut position M2 is set between the second image A2 and a third image A3. When the planned cut position M2 reaches the +X direction with respect to the cutter unit 41 by transporting of the roll paper PR, moving of the cutter unit 41 in the −X direction is started. Then, the second cutting blade 49 (FIG. 3) cuts the roll paper PR in the −X direction. Thus, after cutting the roll paper PR in each of the forward path and the return path, the cutter unit 41 waits at the standby position on an outside in the X direction with respect to the roll paper PR. In this case, the cutter unit 41 remains at a position in the X direction where cutting of the roll paper PR ends.

In this way, the cutter unit 41, for a piece of the roll paper PR, cuts the roll paper PR in each of the forward path and the return path in a state of not returning to the standby position, thus throughput in cutting the roll paper PR can be improved, compared to a configuration in which the cutter unit 41 returns to the standby position on an opposite side of the roll paper PR each time the cutter unit 41 cuts in the X direction once.

Figure 7:
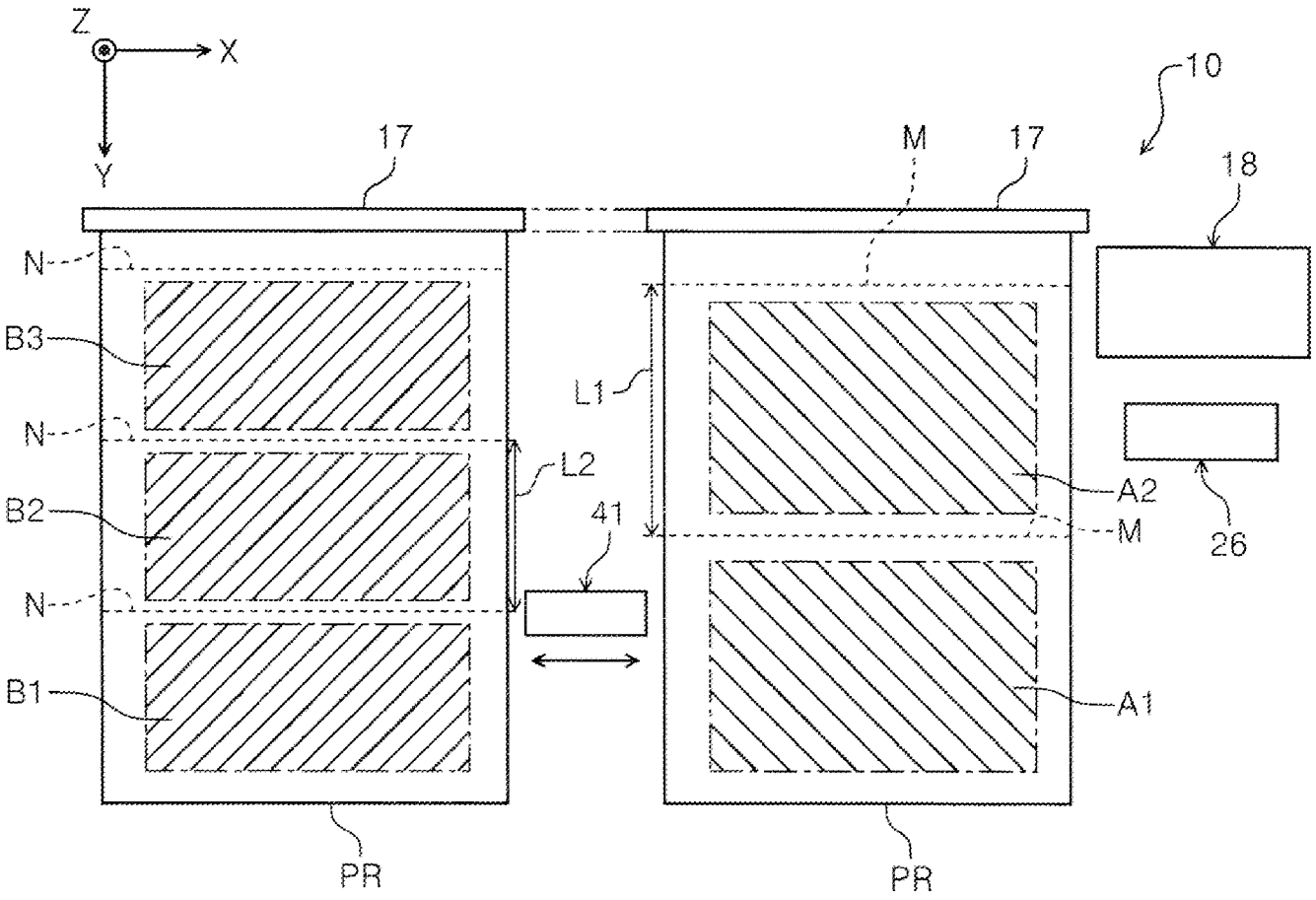
FIG. 7 is a schematic diagram illustrating a state in which the moving unit is positioned between two pieces of roll paper with different cutting positions in the printer according to Exemplary Embodiment 1.

As illustrated in FIG. 7, a case in which two pieces of the roll paper PR are disposed will be described. The image A1 and the image A2 are recorded on the roll paper PR in the +X direction, as an example. In addition, on the roll paper PR in the +X direction, a plurality of the planned cut positions M are set at intervals of length L1 in the Y direction.

An image B1, and image B2, and an image B3 are recorded on the roll paper PR in the −X direction, as an example. In addition, on the roll paper PR in the −X direction, a plurality of planned cut positions N are set at intervals of a length L2 in the Y direction for the image B1, the image B2, and the image B3. The length L2 is shorter than the length L1.

When the two pieces of roll paper PR are disposed, the standby position of the cutter unit 41 is set to a position between the two pieces of roll paper PR. Subsequently, the two pieces of roll paper PR after recording are cut by the cutter unit 41. Specifically, after cutting the roll paper PR in the +X direction at the planned cut position M, the cutter unit 41 is returned to the standby position, which is the position between the two pieces of roll paper PR. Subsequently, after cutting the roll paper PR in the −X direction at the planned cut position N, the cutter unit 41 is returned to the standby position.

In this way, since the standby position is set between the two pieces of roll paper PR, the cutter unit 41 is capable of cutting both the roll paper PR in the +X direction and the roll paper PR in the −X direction at any timing.

As described above, according to the printer 10, the two pieces of roll paper PR after recording by the recording unit 18 are cut by the cutter unit 41 moving in the X direction to form pieces of cut paper PS that are each shingle paper.

Here, in the two pieces of roll paper PR, when recording lengths in the Y direction are different from each other, since the standby position of the cutter unit 41 is set to the position between the two pieces of roll paper PR, the two pieces of roll paper PR can be cut at any timing regardless of which of the two pieces of roll paper PR is to be cut earlier.

According to the printer 10, when a piece of the roll paper PR, which is wide, is cut, the standby position in the X direction of the cutter unit 41 is set to a position, which is the first position, on an outside of any of the pieces of roll paper PR in the X direction. Furthermore, when two pieces of the roll paper PR are cut, the standby position of the cutter unit 41 in the X direction is set to the position, which is the second position, between the two pieces of roll paper PR. This makes it possible to suppress interference of the cutter unit 41 with the transport path K of the roll paper PR, regardless of the number of the pieces of roll paper PR is one or two.

Furthermore, when the two pieces of roll paper PR are cut, the standby position of the cutter unit 41 can be changed according to the size in the X direction of the roll paper PR. In this way, when the size in the X direction of the roll paper PR is small, for example, by setting the second position closer to the roll paper PR, a distance in the X direction between the cutter unit 41 and the roll paper PR is prevented from being excessively large, so it is possible to suppress a delay in start timing of cutting when the cutter unit 41 cuts the roll paper PR. Furthermore, it is possible to support the roll paper PR having various widths. For example, even for a combination of the roll paper PR that is less than half a transport path width and the roll paper PR greater than half the transport path width, recording and cutting are possible.

According to the printer 10, when the two pieces of roll paper PR are cut, the cutter unit 41 returns to the standby position between the two pieces of roll paper PR after cutting the roll paper PR, thus regardless of which of the two pieces of roll paper PR is cut earlier, the two pieces of roll paper PR can be cut at any timing, and it is possible to suppress a delay in start timing of cutting of the roll paper PR.

According to the printer 10, the roll paper PR cut by one of the first cutting blade 48 and the second cutting blade 49 is guided by the guide unit 72 to move in a direction away from another of the first cutting blade 48 and the second cutting blade 49. Thus, the roll paper PR cut by the one of the first cutting blade 48 and the second cutting blade 49 can be prevented from being cut for the second time by the other of the first cutting blade 48 and the second cutting blade 49.

According to the printer 10, when at least a part of the cutter unit 41 is positioned inside the transport region S of the roll paper PR, transport of the roll paper PR in the transport unit 16 is stopped. This prevents the roll paper PR transported by the transport unit 16 from interfering with the cutter unit 41.

According to the control method for the printer 10, similar actions and effects as those of the printer 10 can be obtained.

Exemplary Embodiment 2

Next, a printer 80 of Exemplary Embodiment 2, which is an example of a recording device, will be described with reference to the accompanying drawings. Note that, common components with the printer 10 (FIG. 1) are referenced using like numbers, and no descriptions for such components are provided below.

Figure 9:
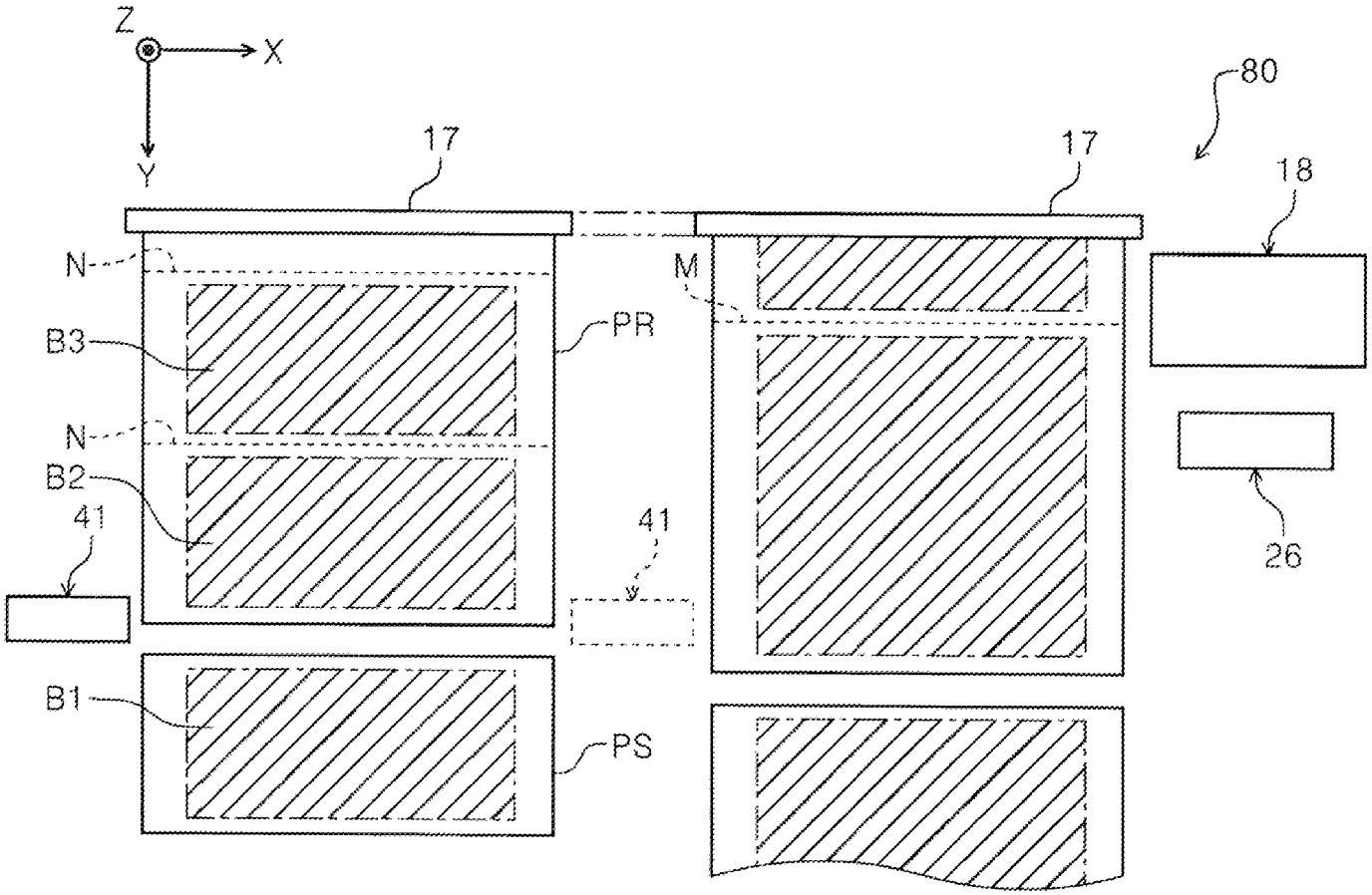
FIG. 9 is a schematic diagram illustrating a state in which the cutting unit after performing a cutting process in a printer according to Exemplary Embodiment 2 is stopped outside roll paper.

In FIG. 9, two pieces of the roll paper PR transported and subjected to recording in the printer 80, the recording unit 18, the control unit 26, and the cutter unit 41 are illustrated.

When one of the two pieces of roll paper PR is cut and subsequently the one roll paper PR is cut, the control unit 26 of Exemplary Embodiment 2 does not return the cutter unit 41 to a standby position between the two pieces of roll paper PR.

As an example, in a state where a recording process and a cutting process for the roll paper PR in the +X direction is completed, and when the recording process and the cutting process are performed for the roll paper PR in the −X direction, the control unit 26 temporarily stops the cutter unit 41 after performing the cutting process while moving from the standby position to an outside in the −X direction, without returning to the standby position. Then, the control unit 26 causes the cutter unit 41 to move in the +X direction and to perform the cutting process in accordance with the next planned cut position M.

Next, actions of the printer 80 of Exemplary Embodiment 2 will be described.

According to the printer 80, the cutter unit 41 is capable of cutting the roll paper PR in both a forward path and a return path in the X direction. Here, when one roll paper PR is continuously cut, the cutter unit 41 is not returned to the standby position between the two pieces of roll paper PR, even when the cutter unit 41 is positioned on an outside in the X direction with respect to the roll paper PR. This eliminates the need for a wait time to return a position of the cutter unit 41, and thus a time required for cutting the roll paper PR can be prevented from extending.

The printers 10 and 80 according to Exemplary Embodiments 1 and 2 of the present disclosure are based on the configuration described above. However, as a matter of course, modifications, omission, combinations, and the like may be made to a partial configuration without departing from the gist of the disclosure of the present application.

In the printers 10 and 80, the control unit 26 may set the standby position to only the second position. The control unit 26 may fix the second position regardless of a size of the roll paper PR, when the cutter unit 41 is at a position not in contact with the roll paper PR before the cutting process. The cutter unit 41 need not include the guide unit 72. The control unit 26 may move the cutter unit 41 outside the transport region S, when at least a part of the cutter unit 41 is positioned inside the transport region S.

The recording unit 18 may be a serial recording head or a line head.

In the printers 10 and 80, in the configuration in which the two pieces of roll papers are wound, pieces of the roll paper PR may be set to be shifted in a girder direction at each of an upper stage and a lower stage, or two pieces of the roll paper PR each having a narrow width may be set at the upper stage. Additionally, a piece of the roll paper PR having a large width may be set on the upper stage, and two pieces of the roll paper PR each having a small width may be set at the lower stage.

What is claimed is:

1. A recording device, comprising:

a transport unit configured to transport two long media in parallel;

a recording unit configured to perform recording on the two long media transported in parallel;

a cutting unit disposed downstream the recording unit in a transport direction of the long medium, configured to move in a width direction intersecting the transport direction, and configured to cut the two long media; and a control unit configured to control the transport unit, the recording unit, and the cutting unit, wherein the cutting unit is configured to cut the long medium in both a forward path and a return path of the movement in the width direction, the control unit is configured to set a standby position of the cutting unit to a position between the two long media, and the cutting unit includes:

a main body portion provided movably in the width direction, a first cutting blade provided on one side with respect to a center in the width direction of the main body portion and configured to cut the long medium in the width direction, and a second cutting blade provided on another side with respect to the center in the width direction of the main body portion and configured to cut the long medium in the width direction.

2. The recording device according to claim 1, wherein the control unit is configured to set a standby position in the width direction of the cutting unit to a first position on an outside in the width direction with respect to the long medium, and to a second position between the two long media.

3. The recording device according to claim 2, wherein the control unit is configured to change the second position in the width direction, in accordance with a size in the width direction of the long medium being transported.

4. The recording device according to claim 1, wherein the control unit returns the cutting unit to a position between the two long media after the cutting unit cuts any one of the two long media.

5. The recording device according to claim 1, wherein the control unit does not return the cutting unit to a position between the two long media when, after one of the two long media is cut, and subsequently the one of the long media is cut.

6. The recording device according to claim 1, wherein the cutting unit further includes a guide unit provided between the first cutting blade and the second cutting blade in the main body portion, and configured to guide the long medium cut by one of the first cutting blade and the second cutting blade in a direction away from another of the first cutting blade and the second cutting blade.

7. The recording device according to claim 1, comprising:

a transmission unit configured to transmit position information in the width direction of the cutting unit to the control unit, wherein the control unit, based on the position information, when at least a part of the cutting unit is positioned inside a transport region of the long medium, stops transport of the long medium by the transport unit.

8. A control method for a recording device including a transport unit configured to transport two long media in parallel, a recording unit configured to perform recording on the two long media transported in parallel, and a cutting unit disposed downstream the recording unit in a transport direction of the long medium, configured to move in a width direction intersecting the transport direction, and configured to cut the two long media, the cutting unit being configured to cut the long medium in both a forward path and a return path of the movement in the width direction, the cutting unit including:

a main body portion provided movably in the width direction, a first cutting blade provided on one side with respect to a center in the width direction of the main body portion and configured to cut the long medium in the width direction, and a second cutting blade provided on another side with respect to the center in the width direction of the main body portion and configured to cut the long medium in the width direction, the control method comprising:

setting a standby position of the cutting unit to a position between the two long media; and causing the cutting unit to cut the two long media on which recording was performed.

* * * * *